US005297653A

United States Patent [19]

Wurtz et al.

[11] Patent Number: 5,297,653

[45] Date of Patent: Mar. 29, 1994

[54] PICKUP TRUCK MOUNTED LIFT APPARATUS

[76] Inventors: Henry J. Wurtz; David J. Wurtz, both of R.R. 2, Box 123, Artesian, S. Dak. 57314

[21] Appl. No.: 42,729

[22] Filed: Apr. 5, 1993

[51] Int. Cl.[5] ..... E04G 1/22

[52] U.S. Cl. ..... 182/63; 182/141; 187/18

[58] Field of Search ..... 182/63, 2, 141, 127; 187/18; 248/277

[56] References Cited

U.S. PATENT DOCUMENTS

| | | | |
|---|---|---|---|
| 2,798,641 | 7/1957 | Coddington | 182/141 X |
| 2,945,551 | 7/1960 | Annin et al. | 182/141 |
| 2,959,244 | 11/1960 | Fedde | 182/63 |
| 3,228,659 | 1/1966 | Sturm | 182/141 X |
| 3,283,850 | 11/1966 | Jones et al. | 182/2 |
| 3,472,337 | 10/1969 | Atchey | 182/2 |
| 3,493,079 | 2/1970 | Dudschus | 182/141 |
| 3,529,694 | 9/1970 | Atchey | 182/2 |
| 3,664,459 | 5/1972 | Stephens et al. | 182/141 |
| 3,768,591 | 10/1973 | Stucky et al. | 182/2 |
| 3,826,334 | 7/1974 | Spillman | 182/2 |
| 3,882,964 | 5/1975 | Schellenberg | 182/63 |
| 4,690,250 | 9/1987 | Bergstrom | 182/141 X |
| 4,890,692 | 1/1990 | Oakman | 182/141 |

FOREIGN PATENT DOCUMENTS

| | | | |
|---|---|---|---|
| 630380 | 9/1978 | U.S.S.R. | 182/63 |

*Primary Examiner*—Alvin C. Chin-Shue
*Attorney, Agent, or Firm*—Moore & Hansen

[57] ABSTRACT

A stable lift apparatus for a pickup truck includes a base which is supported on the sidewalls of the cargo compartment. Each of a pair of scissor assemblies has two lifting arms having the front ends pivotably attached to one of the base and a raisable platform. A pair of hydraulic cylinders moves a central pivot shaft upward to raise the platform. A portable stabilizer has a ground engaging foot adjustable in distance from the stabilizer's pivotable attachment to the lift apparatus or pickup truck. Prior to setting the stabilizer, its length is greater than the distance to the ground. Movement of the truck a short distance sets the stabilizer in a stabilizing mode.

7 Claims, 5 Drawing Sheets

PICKUP TRUCK MOUNTED LIFT APPARATUS

BACKGROUND OF THE INVENTION

This invention relates generally to lift platforms for supporting and raising persons or objects to an elevated position. More particularly, this invention pertains to lift platforms which are mountable in vehicles.

The prior art discloses a variety of portable lift platforms, each of which is intended to be mounted on a truck or trailer bed. For example, U.S. Pat. No. 2,945,551 of Annin et al. shows a portable platform elevating device with a stacked scissor-type lifting apparatus denoted as "lazy tong frames". The lifting apparatus is supported on the bed of a flat bed truck, and is lifted by three sets of hydraulic cylinders. Two sets of cylinders operate in the horizontal plane, and one set generally in the vertical plane. When folded down, the platform is suspended in the air at about cab height.

U.S. Pat. No. 3,664,459 of Stephens et al. describes a somewhat similar lift platform which is elevated from a position above a pickup truck cab. A single hydraulic ram drives the multiple scissor linkage lifting framework from a base bolted to the truck.

One problem with such lifting devices is that when the platform is at its lowest level, it is too elevated above ground level for loading heavy or bulky items thereon without the use of another lifting device such as a front end loader.

Common prior art truck mounted lifting devices which are permanently attached to a truck cannot be easily used to transport a significant quantity of other materials, because of the lengthy time required to detach and remove the device.

BRIEF SUMMARY OF THE INVENTION

A primary objective of the invention is to create a lift apparatus for a pickup truck whereby the lowered position of an elevatable platform is approximately contiguous with the upper surfaces of the sidewalls of the cargo compartment.

A further objective of the invention is to provide a lift apparatus capable of lifting personnel and loads to an elevation of at least six feet above the truck bed.

An objective of the invention is to provide a lift apparatus easily controllable to any position between a lowermost retracted position and a maximum upward extension.

Another objective is to provide a stable pickup truck mounted lift apparatus capable of lifting loads of about ½ ton or more.

A further objective is to provide a pickup truck mounted lift apparatus which leaves a large portion of the truck bed free for carrying/storing tools and/or supplies.

An additional objective is to provide such a lift apparatus whereby closing and locking of the truck tailgate while the lift platform is retracted locks such tools and/or supplies in the bed to prevent theft.

Another objective is to provide a lift apparatus which may be simply removed from the pickup truck by removing a minimal number of bolts and sliding the apparatus rearwardly off the truck.

A further objective is to provide a lift apparatus which may be rapidly constructed of readily available materials.

Another objective is to provide means for stabilizing a pickup truck mounted lift apparatus relative to the ground.

The invention comprises a lift apparatus for pickup trucks. The apparatus has a base which is suspended from the sidewalls of the cargo housing above the truck bed. A movable platform is extendible upwardly from the base by an intervening pair of scissors jacks lifts actuated by hydraulic power cylinders attached to the base.

These and other objects and advantages of the invention will be readily understood by reading the following description in conjunction with the accompanying figures of the drawings wherein like reference numerals have been applied to designate like elements throughout the several views.

DESCRIPTION OF THE PREFERRED EMBODIMENTS

Figure 1:
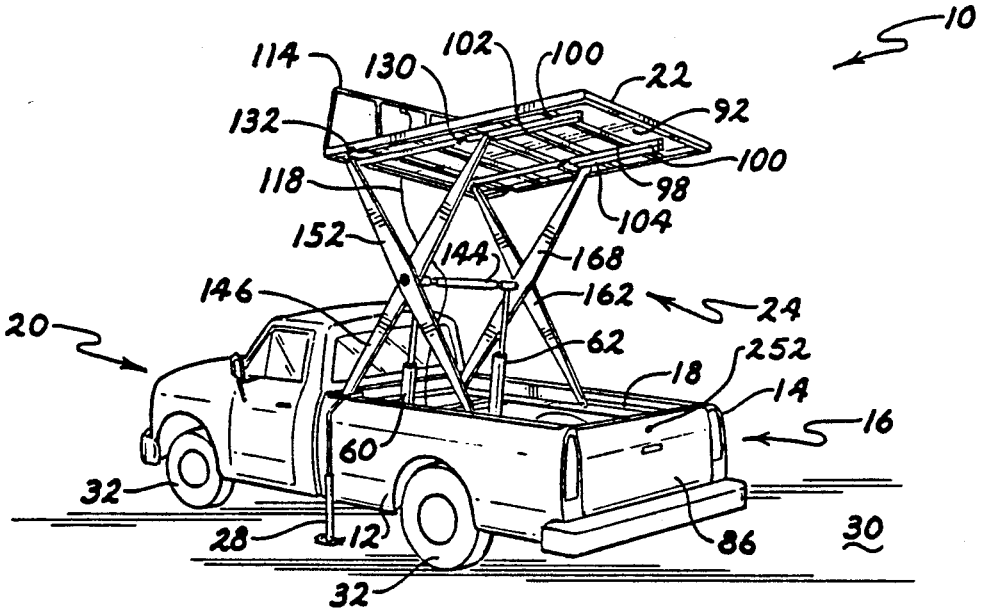
FIG. 1 is a left rear perspective view of the lifting apparatus of the invention mounted on a pickup truck.

With reference to the drawings, and particularly to FIG. 1, a lift apparatus 10 of the invention is shown mounted atop the left sidewall 12 and right sidewall 14 of the cargo compartment 16 of a pickup truck 20. The lift apparatus 10 includes a base assembly 18, a platform assembly 22, an intervening lifting assembly 24 and a hydraulic fluid compression system 26 (see FIGS. 2–4). Also shown is a side-mounted stabilizer 28 for stabilizing the lift apparatus 10 with respect to the ground 30. Stabilizers 28 may be attached to each side of the lift apparatus 10, or alternatively to the truck 20, to reduce or eliminate the movement of the lift apparatus resulting from "give", i.e. pliancy in the truck suspension and tires 32.

Figure 2:
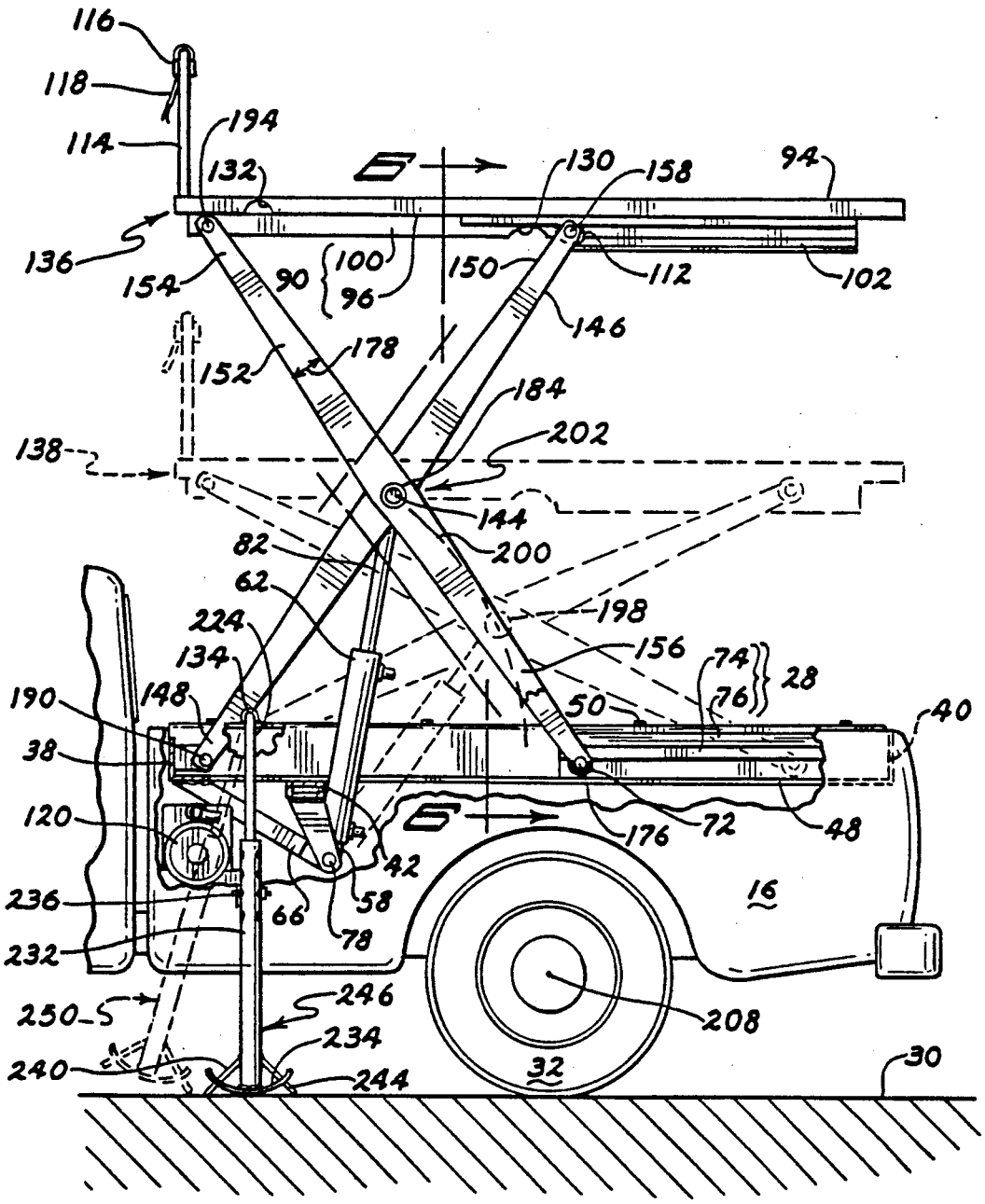
FIG. 2 is a partially cutaway left side view of the lifting apparatus of the invention showing the apparatus in a fully elevated position and in a phantom partially elevated position.
Figure 3:
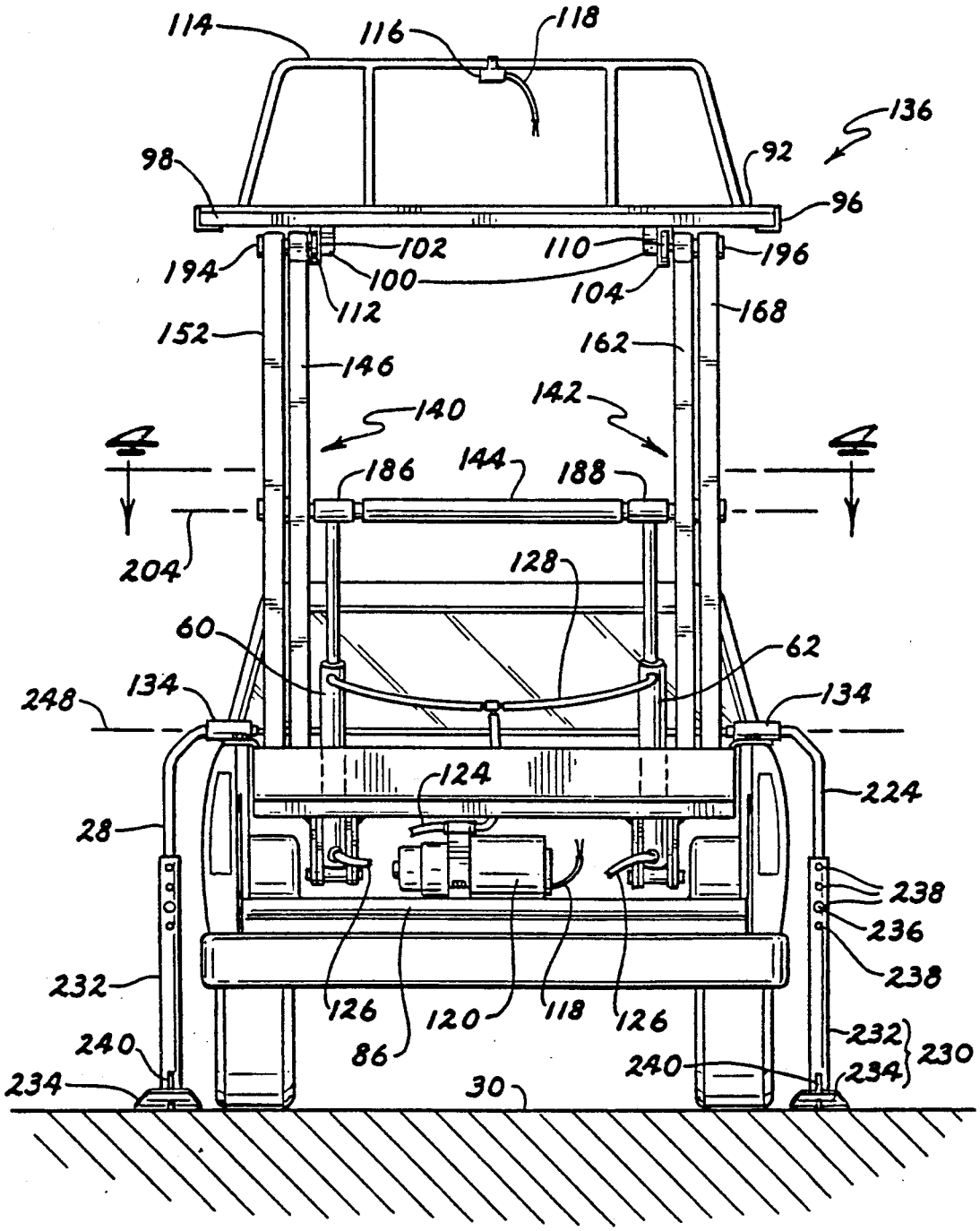
FIG. 3 is a rear end view of the lifting apparatus of the invention in a fully elevated position, with the truck tailgate in a lowered position.
Figure 4:
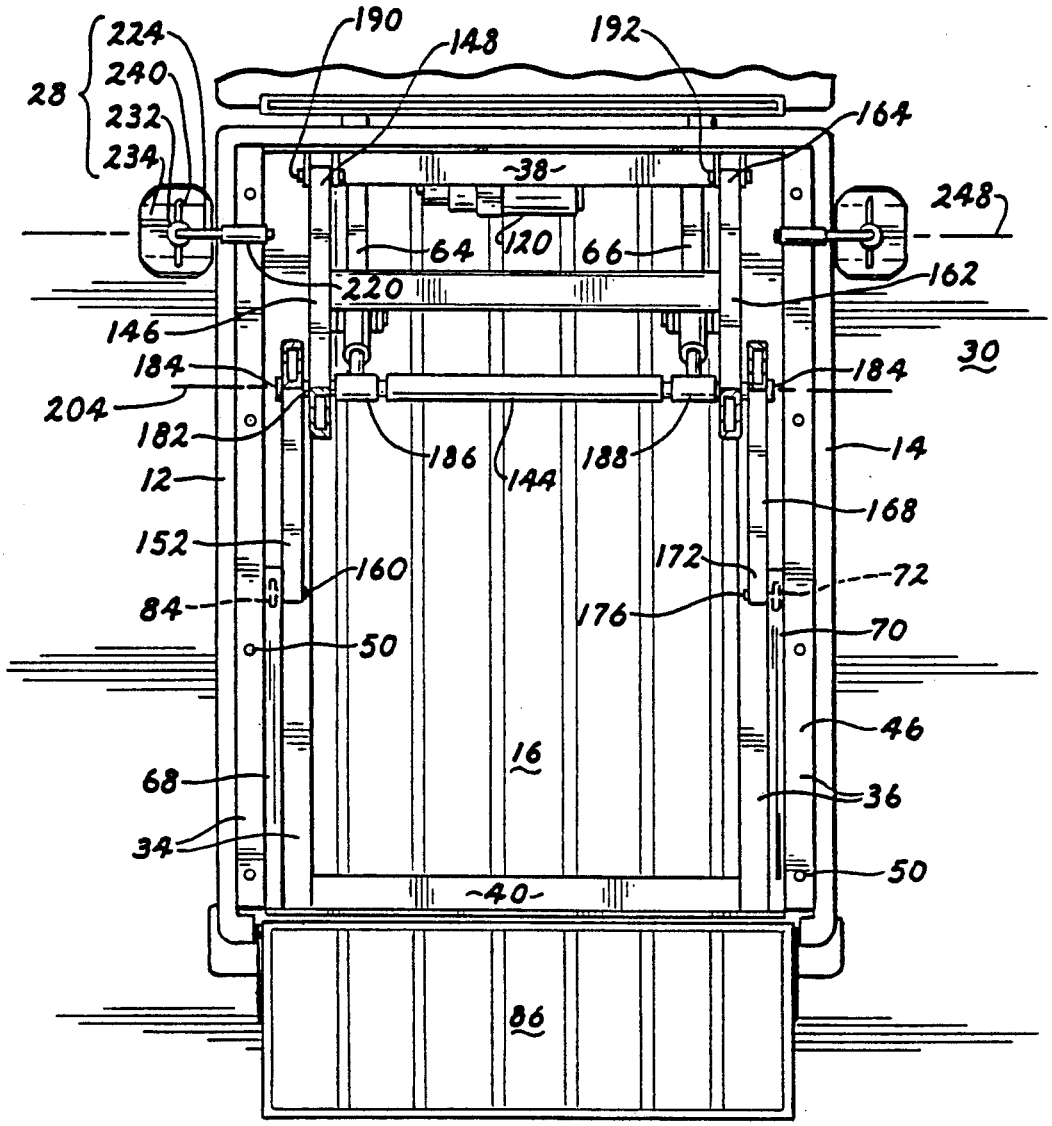
FIG. 4 is a cross-sectional plan view through the lifting apparatus of the invention as taken along line 4—4 of FIG. 3.

Turning now to the various views of the invention as particularly depicted in FIGS. 1–5, the base assembly 18 is shown as a framework comprising a left support rail 34 and a right support rail 36 joined by a front transverse member 38, a rear transverse member 40 and a cylinder supporting cross beam 42 between the front and rear transverse members 38 and 40 (See FIG. 4).

Each of the support rails 34, 36 is formed of a metal bar whose cross-section has a generally vertical component 44 (See FIG. 6) which rides just inside the cargo compartment sidewall 12 or 14. The vertical component 44 is attached to an outwardly directed horizontal upper component 46 which rests on the upper surface 54 of the cargo compartment sidewall 12 or 14. A lower horizontal component 48 of the support rail 34, 36 is attached to the vertical component 44 and extends inwardly. The rails 34, 36 may be formed of e.g. separate flat or L-shaped metal structural members which are welded together, or each rail may be formed by bending a piece of flat metal plate to the requisite shape. The upper component 46 may be attached to the sidewall 12 or 14 by bolt fasteners 50 passing through matching holes 52 in the upper horizontal component 46 and corresponding upper surface 54 of sidewall 12 or 14.

The front transverse member 38 and rear transverse member 40 are shown as comprising L-shaped bars welded to the front and rear ends, respectively of the support rails 34, 36 (See FIGS. 2–5). The cylinder supporting cross beam 42 spans the distance between the forwardmost one-third portions of transverse members 38 and 40. The cross beam 42 preferably comprises a rigid box beam or other beam shape resistant to bending. Suspended from the cross beam 42 are two spaced-apart cylinder support assemblies 56 and 58 to which hydraulic cylinders 60 and 62, respectively, are pivotably attached about pins 78. The cylinder support assemblies 56, 58 are shown as strengthened against distortion by attached braces 64 and 66. Each of these braces is attached at one end to the corresponding support assembly and at its opposite end to the rail 34 or 36 near the front end thereof, and provides the strength to resist the forces produced by the cylinder 60, 62 as it extends its cylinder rod 80, 82 to elevate the platform assembly 22.

Figure 6:
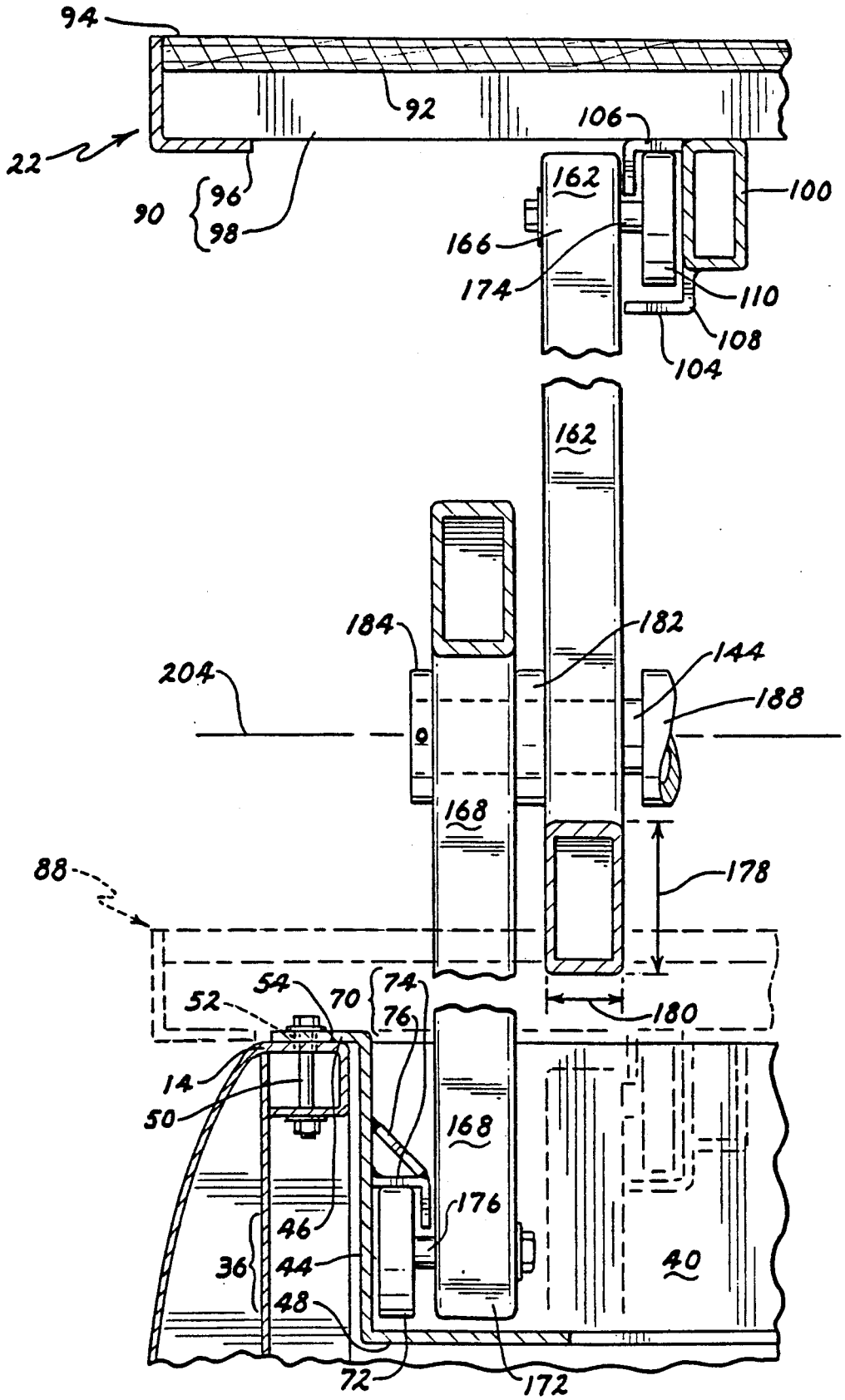
FIG. 6 is an enlarged cross-sectional front end view through the lifting apparatus of the invention as taken along line 6—6 of FIG. 2.

The rearward portion of each rail 34, 36 includes an enclosed longitudinal channel 68, 70, respectively, in which a roller or wheel 72 may supportably ride (FIGS. 2, 4 and 6). As shown in FIG. 6 for the right side rail 36, the right channel 70 is formed by joining, as by welding, an L-shaped bar 74 and reinforcement bar 76 to the vertical component 44 of the rail 36. The length of the channel 70 is sufficient to accommodate the full travel of the wheel 72 in raising and lowering the lift platform assembly 22. The channels 69, 70 typically have lengths comprising major portions of the rear one-half of the rails 34, 36. The left side rail 34 is constructed as a general mirror image of the right side rail 36, having a longitudinal channel 68 for accommodating a roller or wheel 84.

The base assembly 18 comprising the left and right rails 34, 36 with respective wheel channels 68, 70, respective transverse members 38, 40, cross beam 42, respective cylinder support assemblies 56, 58, and braces 64, 66, forms a rigid unitary body which is easily mounted on a pickup truck.

As depicted in a fully elevated position 136 in FIG. 2, the platform assembly 22 includes a framework 90 and a floor 92 having an upper working surface 94 (FIG. 6). The platform assembly 22 is configured to be coextensive with a major portion or preferably all of the cargo compartment i.e. box 16 of the pickup truck 20 when in a retracted, i.e. lowered position. Thus, when the platform assembly 22 is fully lowered, equipment and/or materials in the cargo compartment 16 of the truck 20 may be effectively locked therein by simply closing and locking the tailgate 86.

The platform assembly 22 is shown as having a framework comprising a series of cross members 98 mounted on two or more longitudinal box beams 100 which run the length of the platform assembly. As shown, an outer rim 96 encloses the four sides of the platform and is preferably shown as comprising an L shaped structural member. The floor 92 comprises a generally thin, flat member such as e.g. plywood or a metal grate which overlies the framework 90 and is joined thereto.

Attached to the rearward portion of the underside of the framework 90 are an enclosed left platform channel 102 and right platform channel 104. A left upper roller or wheel 112 confinably moves in left platform channel 102 (FIGS. 2 and 3) and a right upper roller or wheel 110 confinably moves in right platform channel 104 (FIGS. 3 and 6).

As evident in FIGS. 1 and 2, a cutout portion 130 of the longitudinal box beams 100 provides room for the platform assembly 22 to completely collapse onto the support rails 34, 36. Likewise, cutout portions 132 of side peripheral portions of the platform framework 90 provide room for stabilizer bar sockets 134 described below. In the collapsed or retracted position, the tail gate may be locked by e.g. lock 252 to secure any tools or equipment stored in the cargo compartment beneath the platform assembly 22.

As shown in the figures, a hand safety rail 114 is mounted on the front end of the platform assembly 22. The optional rail 114 may be extended on any side(s) of the platform assembly 22 or be e.g. centrally located if so desired.

A hydraulic system controller 116 as known in the art is attached to the rail 114 for easy control by a person on the platform. The controller 116 is connected to a hydraulic fluid pressurization system 112 by conduits 118. The hydraulic system 112 may be powered by the truck's electrical system, not shown. The hydraulic system 112 may include a 3-way electric valve which is controlled by controller 116 to selectively provide pressurized hydraulic fluid to double-acting hydraulic cylinders 60, 62 via hydraulic fluid conduits 124 and either of conduits 126 and 128. The hydraulic fluid is uniformly directed to each cylinder to provide coordinated extension or retraction. If desired, the hydraulic system 112 may be configured so that the platform may be lowered simply by reducing the fluid pressure extending the cylinder rods 80, 82, permitting the weight of the platform to drive it downward. The hydraulic system 112 may comprise any of numerous systems which are available.

The lifting assembly 24 is interposed between the base assembly 18 and the platform assembly 22 for moving the platform assembly 22 between a lowermost position and an elevated position.

The lifting assembly includes a left scissor assembly 140 and a right scissor assembly 142. Each scissor assembly 140, 142 includes a pair of elongate lifting arms which are rotatably mounted at corresponding mid points onto a central shaft 144 and which movably connect the platform assembly 22 to the base assembly 18.

As shown in the figures, the left scissor assembly 140 includes a first lifting arm 146 whose forward end 148 is pivotably attached to the base assembly 18 near the front end thereof. A second lifting arm 152 of the left scissor assembly is mounted on the central shaft 144 adjacent arm 146 and has its forward end 154 pivotably attached to the platform assembly 22 near the front end thereof. The rearward end 150 of the first lifting arm 146 has rotatably attached to it a transverse axle 158 to which is attached the roller or wheel 112. The wheel 112 travels in left platform channel 102, as previously described. The rearward end 156 of the second lifting arm 152 has rotatably attached to it a transverse axle 160 to which is attached a roller or wheel 84 (See FIGS.

4 and 5). Wheel 84 travels in left base channel 68 as previously described.

The right scissor assembly 142 includes a first lifting arm 162 whose forward end 164 is pivotably attached to the base assembly 18 by pin 190 near the front end thereof. A second lifting arm 168 of the right scissor assembly is mounted on the central shaft 144 adjacent arm 162 and has its forward end 164 pivotably attached to the platform assembly 22 near the front end thereof. The rearward end 166 of the first lifting arm 162 has rotatably attached to it a transverse axle 174 to which is attached the roller or wheel 110. The wheel 110 travels in right platform channel 104, as previously described. The rearward end 172 of the second lifting arm 168 has rotatably attached to it a transverse axle 176 to which is attached a roller or wheel 72 (See FIG. 6). Wheel 72 travels in right base channel 70 as previously described.

The left scissor assembly 140 generally joins the left side of the platform assembly 22 to the left side of the base assembly 18. Likewise, the right scissor assembly 142 generally joins the right side of the platform assembly 22 to the right side of the base assembly 18. The left scissor assembly 140 and right scissor assembly 142 are pivotably mounted at or near their midpoints to the respective ends of the central shaft 144.

Each of the axles 158, 160, 174 and 176, and central shaft 144 is mounted in a bearing(s) or bushing, not shown in the drawings, where it rotatably passes through a lifting arm.

Each of the lifting arms 146, 152, 162, and 168 is shown as comprising a structural box beam of varying cross-sectional breadth 178 and constant cross-sectional width 180. The breadth 178 is greatest where the bending forces are greatest, i.e. near the central shaft 144. The arm dimensions are configured to accommodate the high forces exerted in raising the arms and platform assembly 22 to an elevated position.

As shown in FIG. 6, the two lifting arms in each set are laterally separated by a spacer 182. A shaft securing means 184 such as a collet, hub or collar is attached to each end of the central shaft 144 to pivotably secure the shaft 144 to the scissor assemblies 140, 142.

Two hydraulic cylinders 60, 62 have their lower ends pivotably mounted in cylinder support assemblies 56 and 58, respectively, for hydraulic extension of cylinder rods 80 and 82, respectively. Left cylinder rod 80 and right cylinder rod 82 have a terminal bushing 186, 188, respectively, which rotatably connect the rods to the central shaft 144. Cooperative uniform extension of the cylinder rods 80, 82 moves the central shaft 144 upwardly in a semi-circle 200 from a lowermost position shown in FIG. 5 through an intermediate elevated position 198 and to an uppermost position 202 (See FIG. 2). The cylinder rods are extended at the same force so that the axis 204 of the central shaft 144 remains generally parallel with the base assembly 18 throughout its path 200 of movement. At the uppermost position 202 of the central shaft 144, the lifting arms form an angle with the horizontal base assembly 18 of about 45–60 degrees, preferably of about 55 degrees. The hydraulic cylinder rods 80, 82 are connected to the central shaft 144 between the two scissor assemblies 140, 142 and adjacent the inner surface of each scissor assembly. Thus, the two hydraulic cylinders 60, 62 are widely spaced to provide a high degree of stability.

Figure 5:
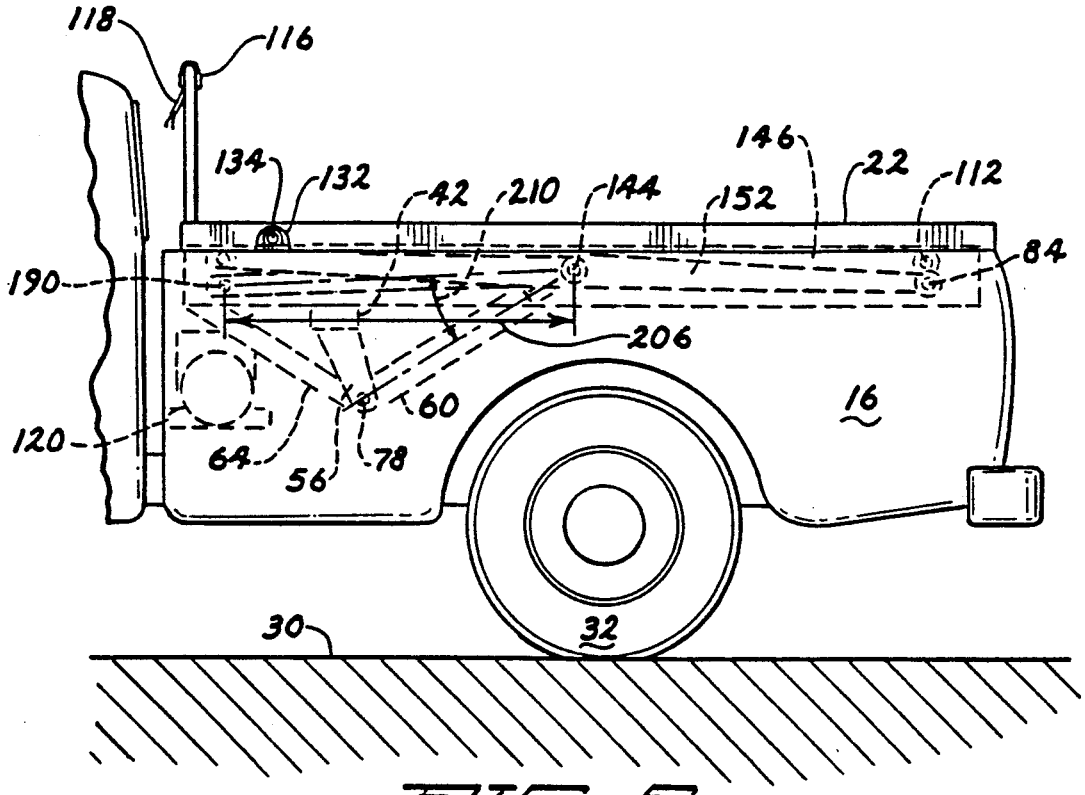
FIG. 5 is a left side view of the lifting apparatus of the invention showing the apparatus in a fully retracted lowered position.

As depicted in FIG. 5, the cylinder support assemblies 56, 58 provide for cylinder support at a location 0.3–0.45 of the horizontal distance 206 from the pins 190, 192 to the fully lowered central shaft 144, i.e. the pin to shaft distance of the lifting arms. The cylinders 60, 62 are supported at a level below the level of the pins 190, 192 equal to about 0.3–0.5 of the distance 206. In the lowermost position, the angle 210 between the first lifting arms 146, 162 and the axes of the cylinder rods 80, 82 is at least 25 degrees and preferably between about 27 and 35 degrees for obtaining the desired mechanical advantage. It has been found that this is the optimum configuration which (a) provides the required lifting capability, i.e. mechanical advantage, from the lowermost position, (b) achieves the necessary force and platform stability at the uppermost position, and (c) permits the use of relatively short hydraulic cylinders. Further lowering of the cylinder support position requires the use of longer cylinders, which in turn requires that the support assemblies be closer to the front of the base, in which position the mechanical advantage is reduced at the fully extended position of the cylinder rods. Any lowering of the cylinder support assemblies to an extent requiring modification of the pickup bed is very undesirable.

The apparatus is designed to be installed with the cylinder support assemblies 56, 58 forward of the midpoint of the support rails, which will be forward of the pickup's rear wheel axis 208, so that the weight is stably supported between the front and rear wheels 32. When the platform assembly 22 is raised above its resting position on the rails 34, 36, it is supported on the lower pins 190, 192 and the cylinders 60, 62. Downward force on the second lifting arms 152, 168 results in the wheels 72, 84 exerting an upward force on the channels 68, 70.

Additional stability of the apparatus may be achieved by the use of a short-swing stabilizer 28. The stabilizer is removably attached at its upper end to a socket 220 or other pivotable attachment means transversely mounted on a support rail 34, 36 of the lift apparatus 10, or attached to another load within the truck 20, or to the truck itself. In the pictured embodiment, the attachment means comprises a socket having a longitudinal axis 248 in a horizontal transverse direction.

The short-swing stabilizer 28 is shown with an elongate bar 224 having a generally horizontal upper portion 226 and a generally vertical lower portion 228 (as viewed in the installed position). The stabilizer 28 has a stand 230 having an upright tubular member 232 attached to a lower ground engaging foot 234. As shown, the bar portion 228 is slidably received within the tubular member 232 and is attached thereto at a selectable height by passing a lock pin 236 through selected aligned holes 238 in the bar portion 228 and the tubular member 232. The foot 234 is shown as an arcuate member rigidly fixed to the tubular member 232 and reinforced on each side by a foot brace 240 (FIGS. 2 and 3). In the embodiment depicted, the braces 240 are continued to project from the bottom 242 of the foot 234 as spikes 244. The spikes are useful to provide an anchor action in soft ground when "setting" the stabilizer 28.

A plurality of holes 238 in the tubular member 232 permits the bar 224 to be joined thereto at a desired selectable stabilizer height for achieving the desired ground-to-foot contact in its "set" or "stabilization" position 246.

As depicted in FIG. 2, the stabilizer 28 is easily set into a stabilization position 246 by mounting the upper portion 226 of the bar 224 into the horizontal socket 220. The length of the stabilizer 28 is adjusted if necessary so that the foot 234 or spike 244 is supported on the ground when the stabilizer is forward or rearward of the vertical stabilization position 246. This forward or rearward non-stabilization position 250 is shown in phantom in FIG. 2 as the former, i.e. forward position. The stabilizer 28 is then moved to the stabilization position 246 by simply driving the truck forward a short distance, typically less than about 1.5–2.5 feet. The foot, being arcuate in cross-section, "rolls" to the desired stabilization position. If desired, the stabilization position 246 may be achieved by moving the stabilizer from a non-stabilization position rearward of the stabilization position 246. The use of the stabilizer(s) permits high loads to be moved from side to side, or end to end, on the platform assembly 22 without a substantial shift in the platform position. Such shifts may otherwise occur, depending upon the rigidity of the truck's suspension system.

The stabilizer 28 is easily returned to a non-stabilization position 250 by merely moving the truck several feet in a forward or backward direction, rolling the foot 234 from its stabilization position. Thus having the weight of the lift apparatus released from the stabilizer 28, it may be dismounted from the lift apparatus or truck if desired.

As described herein, the lift apparatus 10 is easily mounted on a pickup and dismounted therefrom. It is wholly supported by the upper surfaces of the sidewalls, and may be slid forward for mounting and rearward for dismounting. The bolts connecting it to the pickup do not generally support any weight except when there exists a significant horizontal force. Thus, they are easy to install or remove without undue effort.

The configuration of the lifting apparatus provides for a large amount of storage space in the pickup cargo compartment.

When in the retracted position, the platform covers the bed opening of the pickup truck. Thus, the cargo compartment may be lockably sealed simply by locking the tail gate of the truck.

It has been found that as described, there is no need for further bracing between the left and right lifting arms.

The apparatus may be used to lift personnel and/or materials up 6 feet or more for an embodiment having lifting arms of 8.0 feet in length. The total lift is about 7.0 feet when the lift arms attain 61 degrees from the horizontal.

It is anticipated that various changes and modifications may be made in the construction, arrangement, and operation of the truck mounted lift apparatus disclosed herein without departing from the spirit and scope of the invention as defined in the following claims.

What is claimed is:

1. A lift apparatus mountable on a pickup truck for upward extension therefrom, comprising:

a base assembly comprising:

opposing left and right side rails configured for supportable mounting on the upper surfaces of opposing cargo carrier side walls of a pickup truck, said side rails having front and rear ends;

transverse members joining the opposing side rails at the front and rear ends of the base assembly;

a transverse cylinder supporting cross beam having opposing ends joined to the opposing side rails forwardly of the center between the front and rear ends thereof;

two cylinder support assemblies suspended downwardly from said cross beam, said cylinder support assemblies transversely spaced apart and suspended downwardly to have pivotal cylinder mounting means attached thereto at a level below the side rails;

two enclosed lower wheel channels, each lower wheel channel attached to the rearward portion of a side rail and parallel thereto;

a liftable horizontal platform assembly having a framework, a floor and parallel spaced-apart enclosed left and right upper wheel channels, each wheel channel extending along a major portion of the rear one-half of the platform assembly beneath the floor; and a lifting assembly interposed between the base assembly and the platform assembly, said lifting assembly comprising:

a left scissor assembly having first and second lifting arms pivotably joined in a central portion thereof, said first lifting arm having a forward end pivotably attached to the front end of said left rail and a rearward end with a rotatably attached wheel configured to supportably ride in said left upper wheel channel, and said second lifting arm having a forward end pivotably attached to the left front portion of said platform assembly and a rearward end with a rotatably attached wheel configured to supportably ride in said left lower wheel channel;

a right scissor assembly having first and second lifting arms pivotably joined in a central portion thereof, said first lifting arm having a forward end pivotably attached to the front end of said right rail and a rearward end with a rotatably attached wheel configured to supportably ride in said right upper wheel channel, and said second lifting arm having a forward end pivotably attached to the right front portion of said platform assembly and a rearward end with a rotatably attached wheel configured to supportably ride in said right lower wheel channel;

a central shaft having a left end pivotably joining the lifting arms of said left scissor assembly and a right end pivotably joining the lifting arms of said right scissor assembly; and a pair of hydraulic cylinders mounted in said cylinder support assemblies, said hydraulic cylinders having hydraulic power-extensible cylinder rods attached to said central shaft for lifting said central shaft to elevate said platform assembly.

2. The lift apparatus of claim 1, wherein said cylinders are mounted in said cylinder support assemblies to provide an angle of at least 25 degrees between the cylinder rods and the lowered first lifting arms.

3. The lift apparatus of claim I, wherein each said support rail comprises an upper horizontal component which is supportably mounted on the upper surface of a cargo carrier side wall, a vertical component integrally formed with said upper horizontal component to ride on the inside of said cargo carrier side wall, and a lower horizontal component integrally formed with said vertical component.

4. The lift apparatus of claim 3, wherein said lower horizontal component of each rail comprises the lower wall of said lower channel.

5. The lift apparatus of claim I, wherein the hydraulic cylinder rods are spacedly attached to said central shaft generally adjacent the inside surfaces of opposing scissor assemblies.

6. The lift apparatus of claim I, further comprising braces extending forwardly from each said cylinder support assembly to said front transverse member.

7. A lift apparatus mountable on a pickup truck for upward extension therefrom, comprising:

a base assembly comprising:

opposing side rails configured for supportable mounting on the upper surfaces of opposing cargo carrier side walls of a pickup truck, said side rails having front and rear ends;

transverse members joining the opposing side rails at the front and rear ends of the base assembly;

a transverse cylinder supporting cross beam having opposing ends joined to the opposing side rails forwardly of the center between the front and rear ends thereof;

two cylinder support assemblies suspended downwardly from said cross beam, said cylinder support assemblies transversely spaced apart and suspended downwardly to have pivotal cylinder mounting means attached thereto at a level below the side rails;

two enclosed lower wheel channels, each lower wheel channel attached to the rearward portion of a side rail and parallel thereto;

a liftable horizontal platform assembly having a framework, a floor and parallel spaced-apart enclosed left and right upper wheel channels, each wheel channel extending along a major portion of the rear one-half of the platform assembly beneath the floor;

a lifting assembly interposed between the base assembly and the platform assembly, said lifting assembly comprising:

a left scissor assembly having first and second lifting arms pivotably joined in a central portion thereof, said first lifting arm having a forward end pivotably attached to the front end of said left rail and a rearward end with a rotatably attached wheel configured to supportably ride in said left upper wheel channel, and said second lifting arm having a forward end pivotably attached to the left front portion of said platform assembly and a rearward end with a rotatably attached wheel configured to supportably ride in said left lower wheel channel;

a right scissor assembly having first and second lifting arms pivotably joined in a central portion thereof, said first lifting arm having a forward end pivotably attached to the front end of said right rail and a rearward end with a rotatably attached wheel configured to supportably ride in said right upper wheel channel, and said second lifting arm having a forward end pivotably attached to the right front portion of said platform assembly and a rearward end with a rotatably attached wheel configured to supportably ride in said right lower wheel channel;

a central shaft having a left end pivotably joining the lifting arms of said left scissor assembly and a right end pivotably joining the lifting arms of said right scissor assembly; and a pair of hydraulic cylinders mounted in said cylinder support assemblies, said hydraulic cylinders having hydraulic power-extensible cylinder rods attached to said central shaft for lifting said central shaft to elevate said platform assembly; and a short-swing stabilizing assembly, comprising:

a bushing rigidly mounted on the left and right side rails of said pickup truck, said bushings mounted along a transverse axis of said vehicle and having an outwardly facing seat;

a bar having an upper portion configured for generally horizontal insertion in one of said seats and rotatable therein about said transverse axis, and a lower portion pendant downwardly therefrom;

a stand having a lower ground-supportable pad and an upper bar receiver for rigid attachment of said lower portion of said bar thereto, said stand being arcuate in cross-section for short-swing rolling on the ground.

* * * * *